US006247672B1

(12) United States Patent
Bello

(10) Patent No.: US 6,247,672 B1
(45) Date of Patent: Jun. 19, 2001

(54) WRIST REST FOR STENOTYPISTS

(75) Inventor: Raymond Bello, White Plains, NY (US)

(73) Assignee: B.E.S.T. Physical Therapy Injury Prevention Services, P.C., Pelham, NY (US)

( * ) Notice: Subject to any disclaimer, the term of this patent is extended or adjusted under 35 U.S.C. 154(b) by 0 days.

(21) Appl. No.: 09/350,379

(22) Filed: Jul. 9, 1999

(51) Int. Cl.[7] ..... B43L 15/00
(52) U.S. Cl. ..... 248/118.1; 248/918; 400/715
(58) Field of Search ..... 248/118, 118.1, 248/118.5, 918; 400/715

(56) References Cited

U.S. PATENT DOCUMENTS 5,004,196 * 4/1991 Gross ..... 248/918 X
5,158,256 * 10/1992 Gross ..... 248/118.3
5,161,760 * 11/1992 Terbrack ..... 248/118
5,398,896 * 3/1995 Terbrack ..... 248/118.5

* cited by examiner

*Primary Examiner*—Ramon O. Ramirez
(74) *Attorney, Agent, or Firm*—Levine & Mandelbaum

(57) ABSTRACT

A wrist rest for stenotypists and other keyboard operators has an apertured base with two arms mounted thereon via fasteners disposed in apertures in the arms and in an elongated slot in the base. The arms can be rotated, in a common plane, relative to the base, and translated toward and away from each other. The fasteners include a securing device which can be released for adjusting the positions of the arms relative to the base and then engaged for fixing the position of the arms relative to the base. Each arm is covered with a cushion for engaging the forearms and wrists of the operator.

6 Claims, 3 Drawing Sheets

WRIST REST FOR STENOTYPISTS

BACKGROUND OF THE INVENTION

The present invention relates to apparatus for use by a keyboard operator, e.g., a stenotypist, for supporting the forearms and wrists, for comfort and to prevent injury, e.g., carpal tunnel syndrome.

It is known in the art to provide apparatus for supporting the wrists of a keyboard operator during typing, for example, on a computer keyboard. Such devices are often in the form of an elongated cushion designed to be placed on the surface of a desk, keyboard drawer, or other platform, in front of a keyboard. However, a desk or platform surface is not always available for allowing the use of a conventional wrist support. Court stenographers, in particular, often suffer from strain due to their working in an environment where they must be seated on a chair having no arms, and must operate a keyboard device, i.e., a stenographic recording machine, mounted on a column of a tripod with no desk surface available on which to place any means of forearm or wrist support.

SUMMARY OF THE INVENTION

The aforementioned problem of the prior art is overcome by the instant invention which teaches the construction of a device for enabling the forearms and wrists of an operator to be supported in an environment where the operator is seated on a chair without arms, and is operating a keyboard device mounted on a column of a tripod with no desk surface available on which to place any means of forearm or wrist support. More specifically, in accordance with the invention, apparatus for supporting the forearms and wrists of a keyboard operator can be seated on the lap of the operator and readily adjusted to conform to the placement of the operator's forearms and wrists in a position for typing on the keyboard.

The wrist rest of the invention is adapted to be supported on the lap of a keyboard operator and includes a base adapted to be seated on the lap of the operator, left arm means moveably mounted proximal a left end of the base for supporting the left forearm of the operator, right arm means moveably mounted proximal a right end of the base for supporting the right forearm of the operator, left arm fastener means operatively connected to said base and said left arm means for selectively fixing said left arm means to said base thereby preventing movement therebetween, and right arm fastener means operatively connected to said base and said right arm means for selectively fixing said right arm means with respect to said base thereby preventing movement therebetween, and releasing said right arm from said base thereby permitting movement therebetween. The base has an elongated slot with a central longitudinal axis intersecting said first and second arm means, and at least one of said fastener means is disposed within the slot for rotation and translation of the arm means to which it is connected, relative to said base. Each of said arm means is L-shaped and has a major segment and a minor segment. The minor segment has an aperture in which the fastening means is received and the major segment has first and second deformable cushion means mounted thereon in offset relationship for providing a stepped support for the forearm and wrist of the operator.

It is therefore an object of the invention to provide a wrist-rest which can be seated on the lap of a keyboard operator without need for a desk or platform support.

Another object of the invention is to provide a wrist-rest which can support virtually the entire length of the operator's forearms as well as the wrists.

Still another object of the invention is to provide a wrist-rest which has separate adjustments for positioning the left forearm and wrist independently of the right forearm and wrist.

A further object of the invention is to provide a wrist-rest which enables the spacing between the left and right forearms to be fixed.

Still a further object of the invention is to provide a wrist-rest which enables the angle between the left and right forearms to be fixed.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
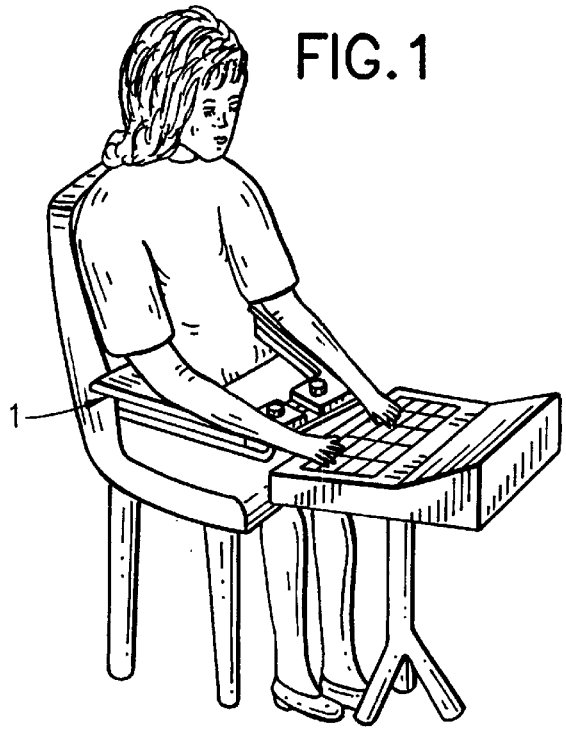
FIG. 1 is an environmental perspective view of a wrist-rest in accordance with the preferred embodiment of the invention.

Referring now to FIG. 1 of the drawings there is shown an operator using a keyboard which may be on a typewriter, computer, or stenotypist's shorthand recording machine. The operator is able to support her forearms and wrists on a wrist rest 1 which is seated in her lap.

Figure 2:
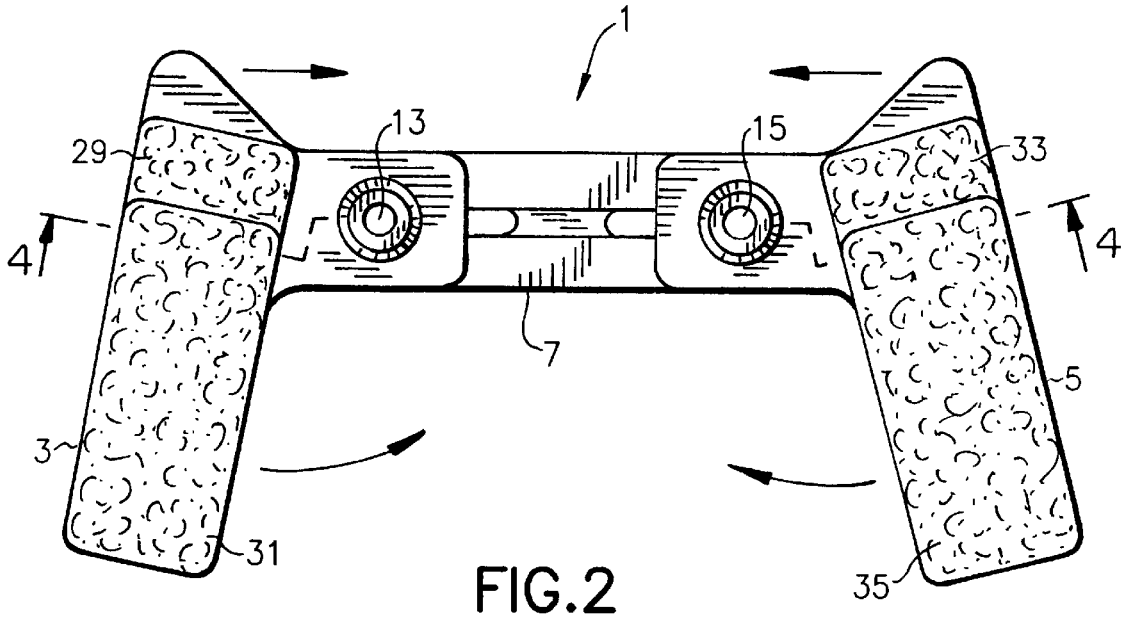
FIG. 2 is a top plan view of the wrist-rest in accordance with the preferred embodiment of the invention, shown in a first disposition.

Referring now to FIG. 2 of the drawings, a wrist rest 1 has a left substantially L-shaped arm 3 and a right substantially L-shaped arm 5 which presents a mirror image of the left arm 3. Each L-shaped arm 3, 5 has a major segment 4, 6 with a length slightly greater than the distance between the wrist and elbow of a typical operator and a transverse minor segment 8, 10 of length less than the length of the major segment and having a circular aperture for receiving the shank of a bolt 13, 15 as will hereinafter be explained.

Mounted on an upper surface of the major segment 4 of left arm 3 are two stacked congruent rectangular cushions 29 and 31, cushion 31 being on top of cushion 29, each cushion 29, 31 having one end proximate the minor segment 8 and an opposite end distal from segment 8. The cushions 29 and 31 are longitudinally offset so that the distal end of the uppermost cushion 31 is more distant from segment 8 than is the distal end of the lowermost cushion 29. An end of the first cushion 29 proximate bolt 13 extends from beneath the cushion 31 for providing a stepped support for the left forearm and wrist of the operator.

Similarly, mounted on an upper surface of the major segment 6 of right arm 5 are two stacked congruent rectangular cushions 33 and 35, cushion 35 being on top of cushion 33, each cushion 33, 35 having one end proximate the minor segment 10 and an opposite end distal from segment 10. The cushions 33 and 35 are longitudinally offset so that the distal end of the uppermost cushion 35 is more distant from segment 10 than is the distal end of the lowermost cushion 33. An end of the first cushion 33 proximate bolt 15 extends from beneath the cushion 35 for providing a stepped support for the right forearm and wrist of the operator.

Cushions 29, 31, 33 and 35 may be made of a soft flexible and/or resilient material. They may be fabricated from hollow envelopes formed from a comfortable fabric material filled with foam rubber, or a liquid or gel which is displaceable for conforming their upper surfaces to the operator's forearms and wrists.

Complimentary releasable hook and loop fabric fastener strips 37, e.g, ones sold under the trademark Velcro, are attached to the upper surface of the left arm 3 and the lower surface of lower cushion 29, respectively, for enabling the lower cushion 29 to be releasably affixed to the arm 3. Additional releasable fastening strips 39 are attached to the upper surface of the lower cushion 29 and the lower surface of upper cushion 31, respectively, for enabling the upper cushion 31 to be releasably affixed to lower cushion 29. Likewise, releasable fastening strips 41 are attached to the upper surface of the right arm 5 and the lower surface of lower cushion 33, respectively, for enabling the lower cushion 33 to be releasably affixed to the arm 3. Additional releasable fastening strips 43 are attached to the upper surface of the lower cushion 33 and the lower surface of upper cushion 35, respectively, for enabling the upper cushion 35 to be releasably affixed to lower cushion 33.

Figure 3:
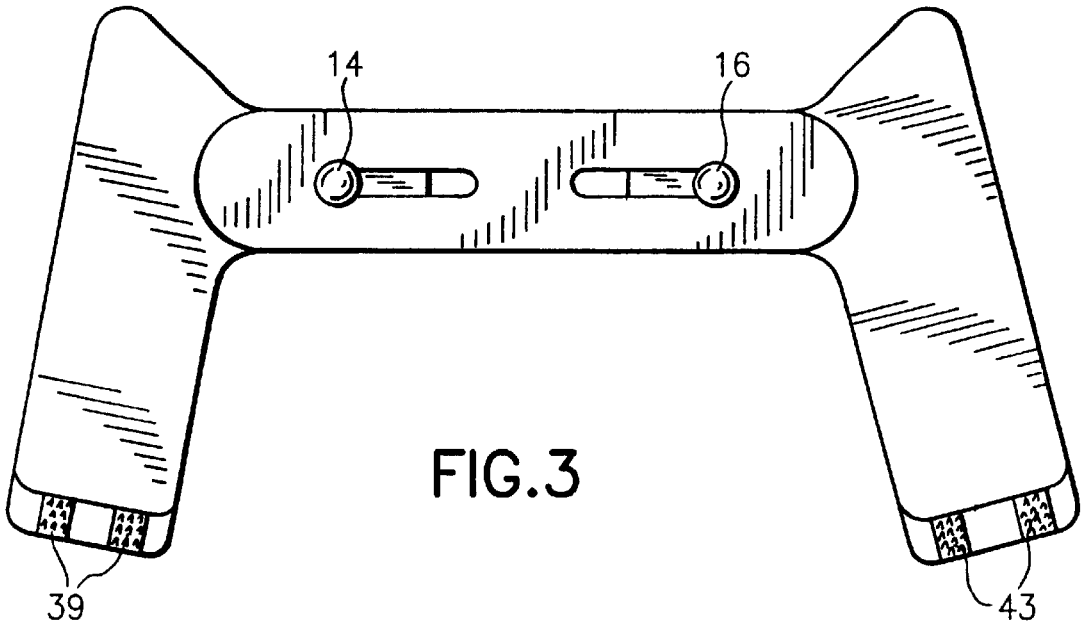
FIG. 3 is a bottom plan view of the wrist-rest in accordance with the preferred embodiment of the invention, shown in the first disposition.
Figure 4:
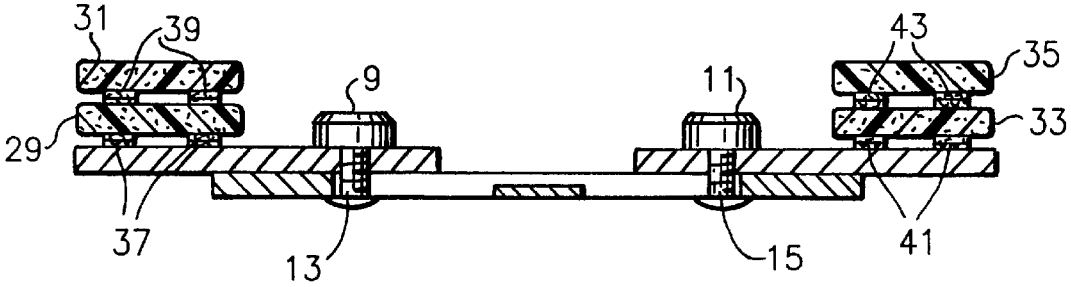
FIG. 4 is a sectioned side elevation view of the wrist-rest in accordance with the preferred embodiment of the invention, shown in the first disposition.

An elongated base 7 having a length great enough to span the lap of a typical keyboard operator is formed from a plate having a central axial slot. The arms 3 and 5 are mounted on the base via threaded bolts 13 and 15 which are respectively passed through the axial slot in the base 7 and the apertures in the respective minor segments 8 and 10 so that each head 14, 16 of respective bolts 13 and 15 is on the underside of the base 7 as can best be seen in FIGS. 3 and 4. Knobs 9 and 11 have threaded blind apertures for receiving the free ends of the bolts 13 and 15 which are opposite the ends of the bolts having heads. When the knobs 9 and 11 are loosened, friction between the arms 3 and 5 and the base 7 is relieved, and the arms 3 and 5 may, respectively, may be independently rotated in the plane of the lap plate 7 and longitudinally translated toward or away from each other.

Figure 5:
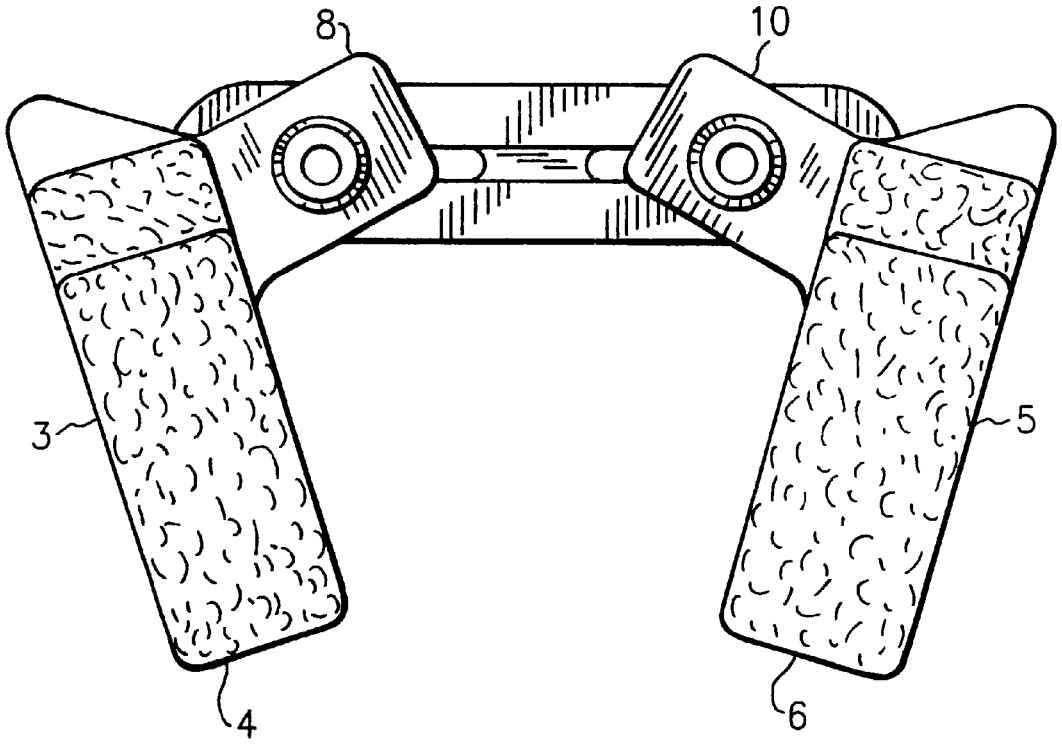
FIG. 5 is a top plan view of the wrist-rest in accordance with the preferred embodiment of the invention, shown in a second disposition.

In use, the wrist rest is positioned with the base 7 across the thighs of the seated operator and the arms 3 and 5 extending rearwardly above the operator's hips. The operator can disengage the fasteners 13 and 15 by loosening knobs 9 and 11 to adjust the spacing and angle of the arms 3 and 5 for comfort. Thereafter, the knobs 9 and 11 can be tightened to increase friction between the arms 3 and 5 and the base 7 to fix the arms 3 and 5 in a comfortable position. For example the angles of the arms 3 and 5 with respect to the base 7 can be altered from that shown in FIG. 1 to that illustrated in FIG. 5. The operator may then rest his or her wrists, forearms, and/or elbows on the wrist-rest.

It is to be appreciated that the foregoing is a description of a preferred embodiment of the invention to which variations and modifications may be made without departing from the spirit and scope of the invention.

What is claimed is:

1. A wrist rest adapted to be supported on the lap of an operator of a keyboard, said wrist rest comprising a base having, a rear edge proximate the torso of the operator when seated on the lap of the operator, and a forward edge proximate said keyboard, left arm means moveably mounted proximal a left end of the base and extending rearwardly of said base rear edge a distance sufficient for supporting the left forearm of the operator, right arm means moveably mounted proximal a right end of the base and extending rearwardly of said base rear edge a distance sufficient for supporting the right forearm of the operator, whereby said base, left arm means and right arm means can partially surround the torso, left arm fastener means operatively connected to said base and said left arm means for selectively fixing said left arm means to said base thereby preventing movement therebetween, and releasing said left arm from said base thereby permitting movement therebetween, and right arm fastener means operatively connected to said base and said right arm means for selectively fixing said right arm means with respect to said base thereby preventing movement therebetween, and releasing said right arm from said base thereby permitting movement therebetween.

2. A wrist rest according to claim 1 wherein said base has an elongated slot with a central longitudinal axis intersecting said first and second arm means, and at least one of said fastener means is disposed within the slot for rotation and translation of the arm means to which it is connected, relative to said base.

3. A wrist rest adapted to be supported on the lap of a keyboard operator, said wrist rest comprising a base adapted to be seated on the lap of the operator, left arm means moveably mounted proximal a left end of the base for supporting the left forearm of the operator, right arm means moveably mounted proximal a right end of the base for supporting the right forearm of the operator, left arm fastener means operatively connected to said base and said left arm means for selectively fixing said left arm means to said base thereby preventing movement therebetween, and releasing said left arm from said base thereby permitting movement therebetween, and right arm fastener means operatively connected to said base and said right arm means for selectively fixing said right arm means with respect to said base thereby preventing movement therebetween, and releasing said right arm from said base thereby permitting movement therebetween, wherein each of said arm means is L-shaped and has a major segment and a minor segment, and the minor segment has an aperture in which the fastening means is received.

4. A wrist rest according to claim 1 wherein each of said arm means is L-shaped and has a major segment and a minor segment, and the major segment has first deformable cushion means mounted thereon.

5. A wrist rest adapted to be supported on the lap of a keyboard operator, said wrist rest comprising a base adapted to be seated on the lap of the operator, left arm means moveably mounted proximal a left end of the base for supporting the left forearm of the operator, right arm means moveably mounted proximal a right end of the base for supporting the right forearm of the operator, left arm fastener means operatively connected to said base and said left arm means for selectively fixing said left arm means to said base thereby preventing movement therebetween, and releasing said left arm from said base thereby permitting movement therebetween, and right arm fastener means operatively connected to said base and said right arm means for selectively fixing said right arm means with respect to said base thereby preventing movement therebetween, and releasing said right arm from said base thereby permitting movement therebetween, wherein each of said arm means is L-shaped and has a major segment and a minor segment, and the major segment comprises first deformable cushion means mounted thereon and second deformable cushion means mounted atop the first deformable cushion means.

6. A wrist rest according to claim 5 wherein the second deformable cushion means is longitudinally offset from the first deformable cushion means with an end of the first cushion means proximate the fastener means extending from beneath the second cushion means for providing a stepped support for the forearm and wrist of the operator.

* * * * *